US008162615B2

(12) United States Patent
Maalouf et al.

(10) Patent No.: US 8,162,615 B2
(45) Date of Patent: Apr. 24, 2012

(54) SPLIT DISK ASSEMBLY FOR A GAS TURBINE ENGINE

(75) Inventors: Fadi S. Maalouf, East Hampton, CT (US); Eric W. Malmborg, Amston, CT (US); Matthew E. Bintz, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 532 days.

(21) Appl. No.: 12/405,272

(22) Filed: Mar. 17, 2009

(65) Prior Publication Data

US 2010/0239424 A1 Sep. 23, 2010

(51) Int. Cl.
*F01D 5/30* (2006.01)

(52) U.S. Cl. ..... 416/214 A

(58) Field of Classification Search ..... 416/214, 416/219 R, 214 A

See application file for complete search history.

(56) References Cited

U.S. PATENT DOCUMENTS

| | | | | |
|---|---|---|---|---|
| 5,222,863 | A * | 6/1993 | Jones | 415/199.5 |
| 5,489,194 | A * | 2/1996 | Yoshinari et al. | 416/241 R |
| 5,622,475 | A | 4/1997 | Hayner et al. | |
| 6,234,756 | B1 | 5/2001 | Ress, Jr. et al. | |
| 6,375,428 | B1 | 4/2002 | Stangeland et al. | |
| 6,520,743 | B2 | 2/2003 | Arilla et al. | |
| 6,575,703 | B2 | 6/2003 | Simeone et al. | |
| 6,733,233 | B2 | 5/2004 | Jasklowski et al. | |
| 6,739,837 | B2 | 5/2004 | Barnette et al. | |
| 6,837,686 | B2 | 1/2005 | Di Paola et al. | |
| 6,884,028 | B2 | 4/2005 | Brauer et al. | |
| 6,971,855 | B2 * | 12/2005 | Richards et al. | 416/220 R |
| 7,040,866 | B2 | 5/2006 | Gagner | |
| 7,121,802 | B2 | 10/2006 | Athans et al. | |
| 7,185,484 | B2 | 3/2007 | Griffin, III et al. | |
| RE39,630 | E | 5/2007 | Stangeland et al. | |
| 7,220,100 | B2 | 5/2007 | Lee et al. | |
| 7,238,008 | B2 | 7/2007 | Bobo et al. | |
| 7,244,105 | B2 | 7/2007 | Moeller | |
| 7,300,246 | B2 | 11/2007 | Durocher et al. | |
| 7,300,416 | B2 | 11/2007 | Botich et al. | |
| 7,334,331 | B2 | 2/2008 | Bouchard et al. | |
| 7,334,392 | B2 | 2/2008 | Moniz et al. | |
| 7,338,258 | B2 | 3/2008 | Bachofner et al. | |
| 7,377,747 | B2 | 5/2008 | Lee | |
| 7,448,221 | B2 | 11/2008 | Suciu et al. | |
| 7,607,286 | B2 * | 10/2009 | Suciu et al. | 60/226.1 |
| 7,690,896 | B2 * | 4/2010 | Stevens et al. | 416/219 R |
| 7,874,802 | B2 * | 1/2011 | Suciu et al. | 416/191 |
| 7,878,762 | B2 * | 2/2011 | Suciu et al. | 416/191 |
| 7,887,288 | B2 * | 2/2011 | David | 415/200 |
| 7,918,652 | B2 * | 4/2011 | Fujimura | 416/219 R |
| 7,927,069 | B2 * | 4/2011 | Erickson et al. | 415/173.7 |
| 8,016,565 | B2 * | 9/2011 | Berg et al. | 416/219 R |
| 2007/0295011 | A1 * | 12/2007 | Suciu et al. | 60/772 |

* cited by examiner

*Primary Examiner* — Nathan Ha

(74) *Attorney, Agent, or Firm* — Carlson Gaskey & Olds, P.C.

(57) ABSTRACT

A split disk assembly for a gas turbine engine includes a forward disk section and an aft disk section, the aft disk section engageable with the forward disk section to retain a multitude of rotor blades therebetween.

20 Claims, 7 Drawing Sheets

SPLIT DISK ASSEMBLY FOR A GAS TURBINE ENGINE

BACKGROUND

The present application relates to a gas turbine engine, and more particularly to compressor blade attachment thereof.

Gas turbine engines often include a multiple of rotor assemblies within a fan, compressor and turbine section. Each rotor assembly has a multitude of blades attached about a circumference of a rotor disk. Each of the blades is spaced a distance apart from adjacent blades to accommodate movement and expansion during operation.

Gas turbine engine compressor rotor blades are typically attached in loading slots of a rotor disk rim. The blades are then locked into place with bolts, peening, locking wires, pins, keys, plates, or other locking hardware. The blades need not fit too tightly in the rotor disk due to the centrifugal forces during engine operation. Some blade movement also may reduce the vibrational stresses produced by high-velocity airstreams between the blades. In such a bladed rotor assembly, the loading slots may increase rotor disk stresses and may ultimately reduce the overall life of the rotor disk.

SUMMARY

A split disk assembly for a gas turbine engine according to an exemplary aspect of the present disclosure includes a forward disk section and an aft disk section, the aft disk section engageable with the forward disk section to retain a multitude of rotor blades therebetween.

A split disk assembly for a gas turbine engine according to an exemplary aspect of the present disclosure includes a forward disk section which at least partially defines an engine stage and an aft disk section which at least partially defines another engine stage, said aft disk section engageable with said forward disk section to retain a multitude of rotor blades therebetween.

A split disk assembly for a gas turbine engine according to an exemplary aspect of the present disclosure includes a disk section and a hub section, said hub section engageable with said disk section to retain a multitude of rotor blades therebetween.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
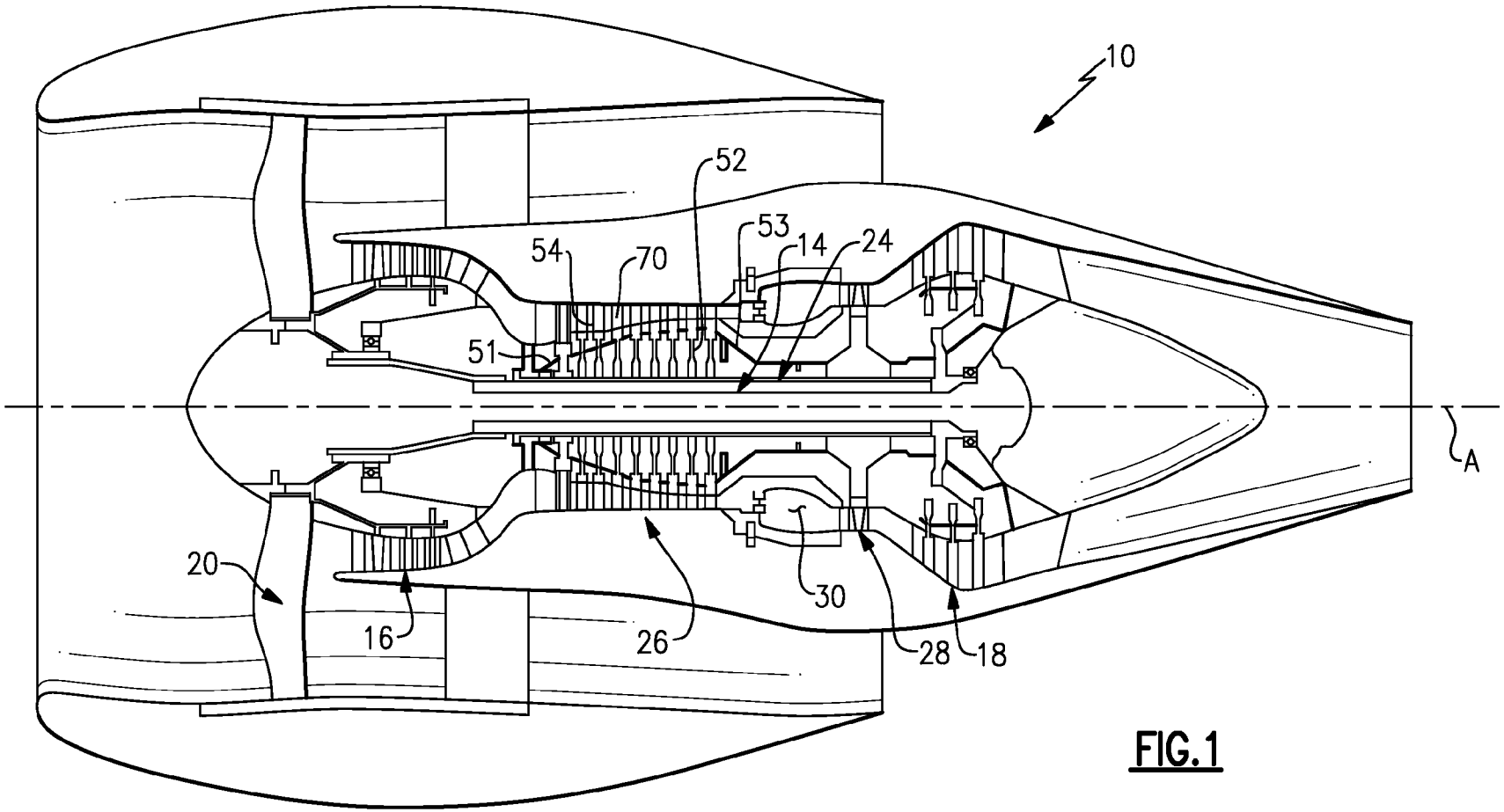
FIG. 1 is a general schematic sectional view through a gas turbine engine along the engine longitudinal axis.

FIG. 1 illustrates a general schematic view of a gas turbine engine 10 such as a gas turbine engine for propulsion. While a two spool high bypass turbofan engine is schematically illustrated in the disclosed non-limiting embodiment, it should be understood that the disclosure is applicable to other gas turbine engine configurations, including, for example, gas turbines for power generation, turbojet engines, low bypass turbofan engines, turboshaft engines, etc.

The engine 10 includes a core engine section that houses a low spool 14 and high spool 24. The low spool 14 includes a low pressure compressor 16 and a low pressure turbine 18. The core engine section drives a fan section 20 connected to the low spool 14 either directly or through a gear train. The high spool 24 includes a high pressure compressor 26 and high pressure turbine 28. A combustor 30 is arranged between the high pressure compressor 26 and high pressure turbine 28. The low and high spools 14, 24 rotate about an engine axis of rotation A.

Air compressed in the compressor 16, 26 is mixed with fuel, burned in the combustor 30, and expanded in turbines 18, 28. The air compressed in the compressors 16, 18 and the fuel mixture expanded in the turbines 18, 28 may be referred to as a hot gas stream along a core gas path. The turbines 18, 28, in response to the expansion, drive the compressors 16, 26 and fan 14.

The high pressure compressor 26 includes alternate rows of rotary airfoils or blades 70 mountable to disks 52 (also illustrated in FIG. 3) and vanes 54 fixed within an engine structure. It should be understood that a multiple of disks 52 may be contained within each engine section and that although a single disk in the high pressure compressor section 26 is illustrated and described in the disclosed embodiment, other sections which have other blades such as fan blades, low pressure turbine blades, high pressure turbine blades, high pressure compressor blades and low pressure compressor blades may also benefit herefrom.

Figure 2:
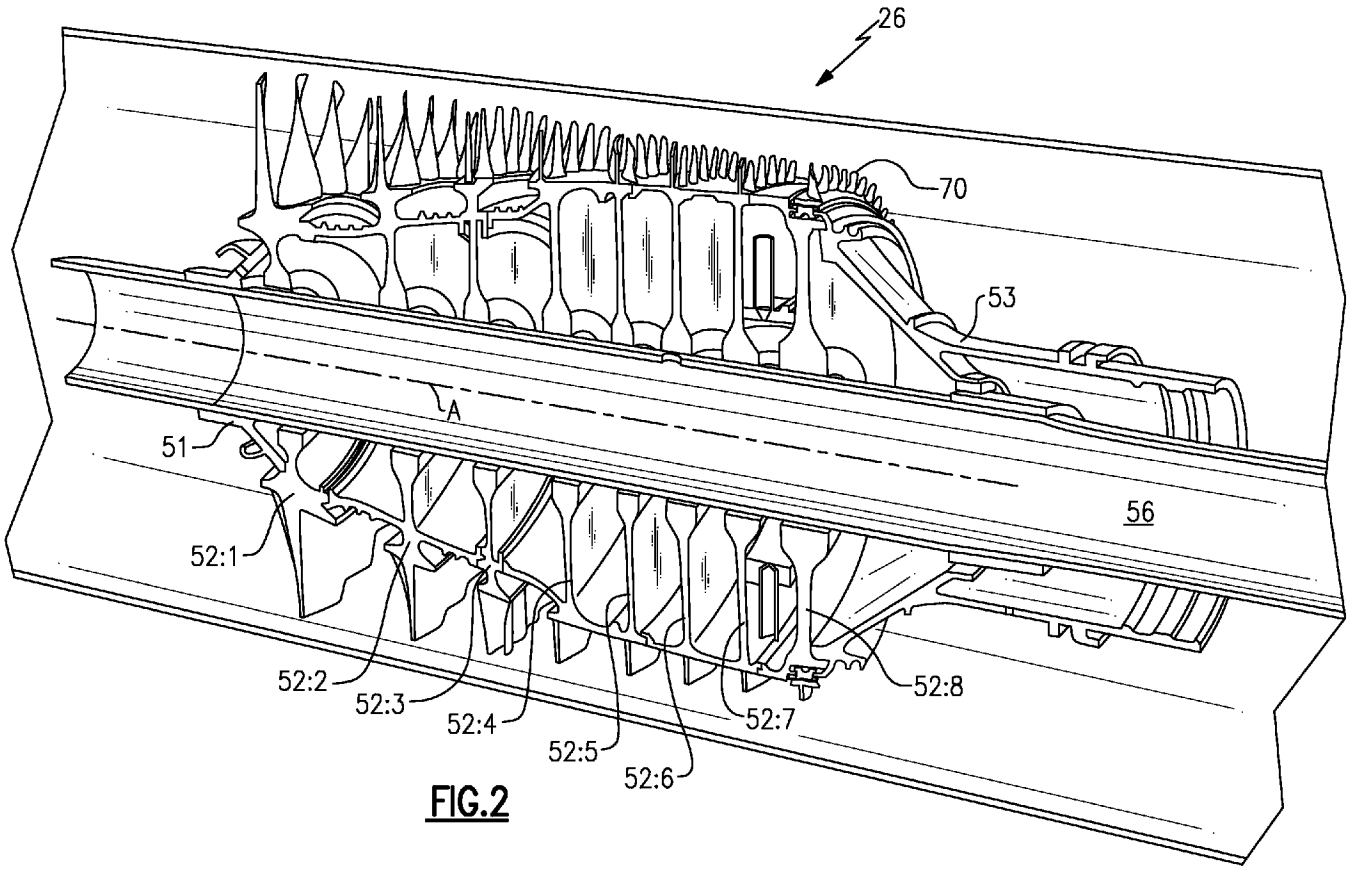
FIG. 2 is a perspective sectional view through a the high pressure compressor of the gas turbine engine.

Referring to FIG. 2, the high pressure compressor 26 generally includes a tie-shaft 56 which supports a multitude of rotor disks 52:1-52:8, a forward hub 51 and an aft hub 53. Each of the multitudes of rotor disks 52:1-52:8 support a plurality of blades 70 circumferentially disposed around a periphery of the respective rotor disk 52:1-52:8. The plurality of blades 70 supported on the respective rotor disks 52:1-52:8 generally define a portion of a stage within the high pressure compressor 26 (FIG. 1).

The tie-shaft 56 provides an axial preload which compresses all of the rotor disks 52:1-52:8. This compressive load maintains the assembly as a single rotary unit. The tie-shaft 56 may also facilitate a "snap" fits which further maintains the concentricity of rotor disks 52:1-52:8. The tie-shaft 56 maintains the axial preload between the aft hub 53, the multitudes of disks 52:1-52:8 and the forward hub 51.

Figure 3:
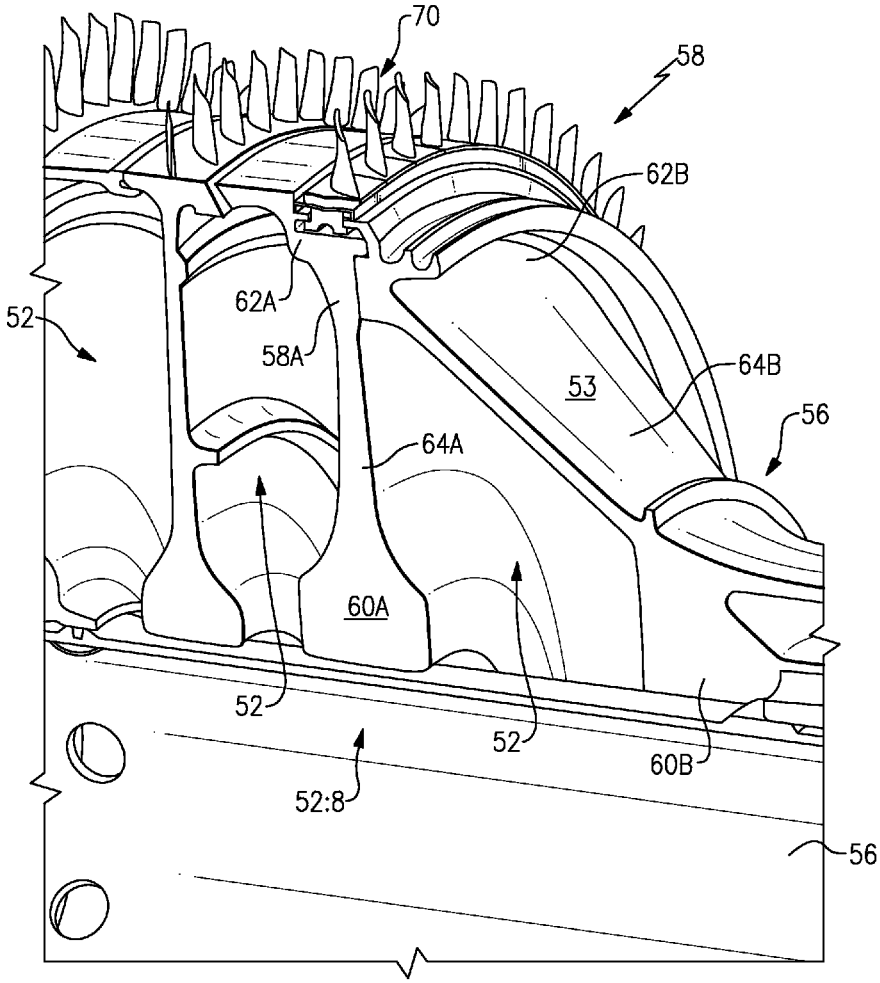
FIG. 3 is an expanded perspective sectional view through the last stages of the high pressure compressor.

Referring to FIG. 3, rotor disk 52:8 is illustrated in the disclosed non-limiting embodiment as a split disk assembly 58. Although rotor disk 52:8 will be described in detail herein, it should be understood that each or any rotor disk 52:1-52:8 may be formed as a split disk assembly as illustrated in the disclosed non-limiting embodiment. The split disk assembly 58 generally includes a forward disk section 58A and an aft disk section 58B, each section of which respectively includes a hub 60A, 60B, a rim 62A, 62B, and a web 64A, 64B which extends therebetween. The forward disk section 58A and the aft disk section 58B are retained together with the tie-shaft 56 upon which the split rotor disk assembly 58 is driven.

In one disclosed non-limiting embodiment, the forward disk section 58A of the split disk assembly 58 forms a portion of the $8^{th}$ stage integrally bladed rotor, while the aft disk section 58B of the split disk assembly 58 forms a portion of the aft hub 53. It should be understood that each stage may alternatively be formed from a portion of a forward stage and a portion of the adjacent aft stage until the $1^{st}$ stage is formed by a forward disk section of the $1^{st}$ stage integrally bladed rotor, while the aft disk section is formed by a portion of the forward hub 51.

Figure 4:
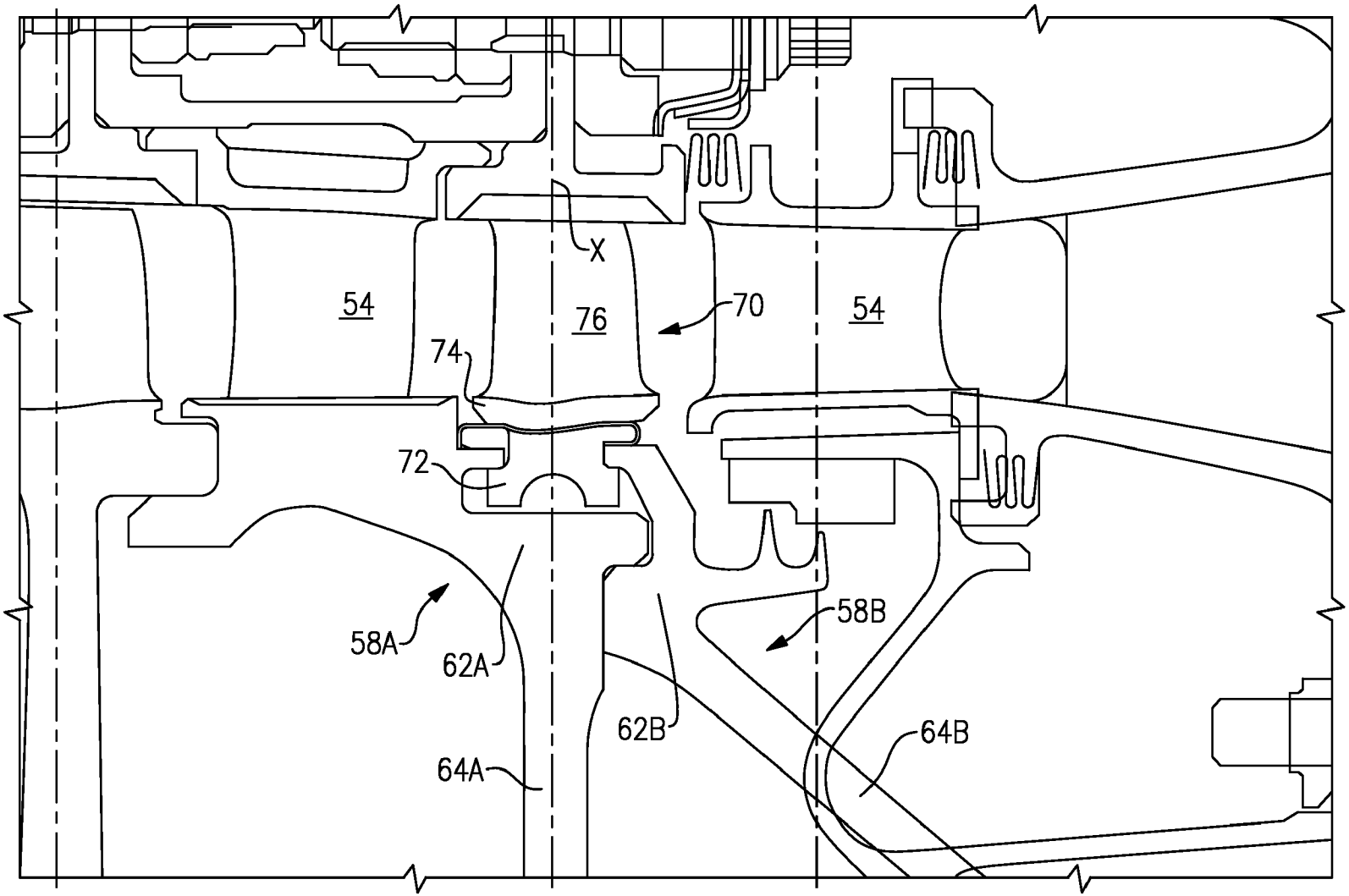
FIG. 4 is an expanded sectional view through a split disk assembly of the last stages of the high pressure compressor.
Figure 5:
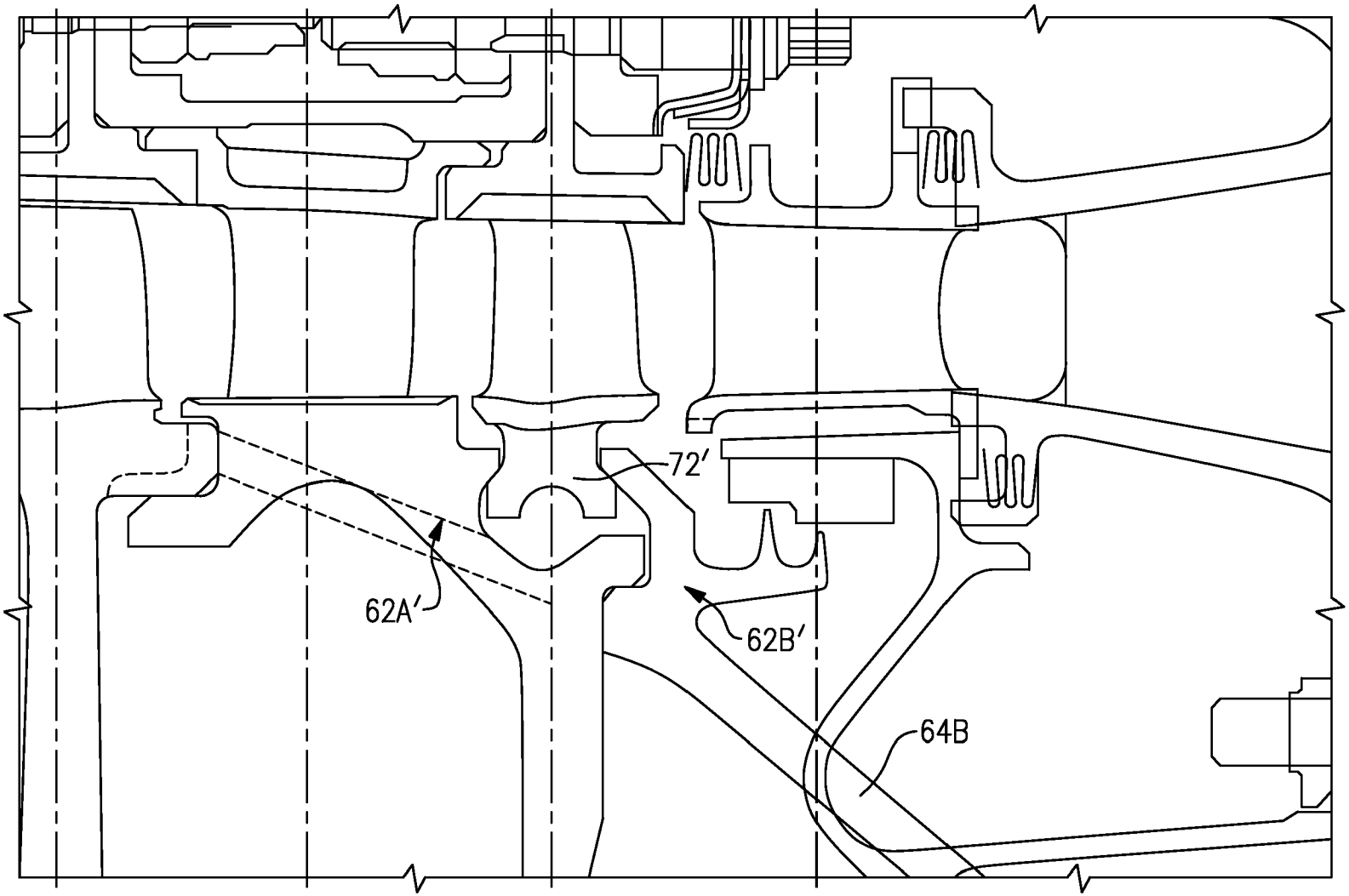
FIG. 5 is an expanded sectional view through another embodiment of the split disk assembly of the last stages of the high pressure compressor.
Figure 6:
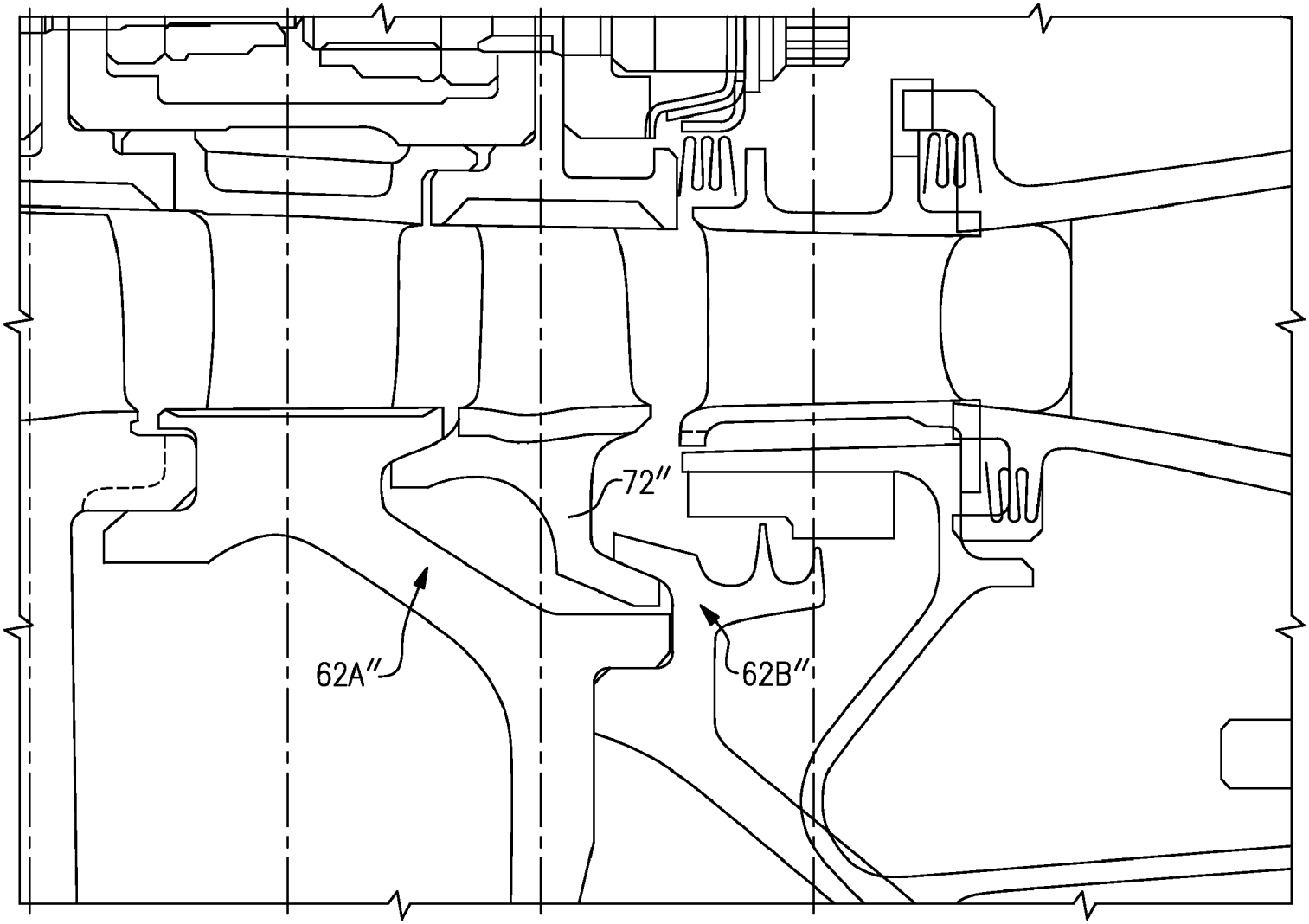
FIG. 6 is an expanded sectional view through another embodiment of the split disk assembly of the last stages of the high pressure compressor.

Each blade 70 generally includes a blade attachment section 72, a blade platform section 74 and a blade airfoil section 76 along a longitudinal axis X (FIG. 4). Each of the blades 70 is received between the forward disk section 58A and the aft disk section 58B generally within the respective rims 62A, 62B. The respective rims 62A, 62B form the blade retention interface feature which engage with the blade attachment section 72. This interface feature 62A', 62B', 72; 62A", 62B", 72" may be of various forms such as that disclosed in the alternative non-limiting embodiments of FIGS. 5 and 6. Separable forward disk section 58A and aft disk section 58B also facilitates a less complicated blade attachment section 72 retention feature configuration.

Figure 7:
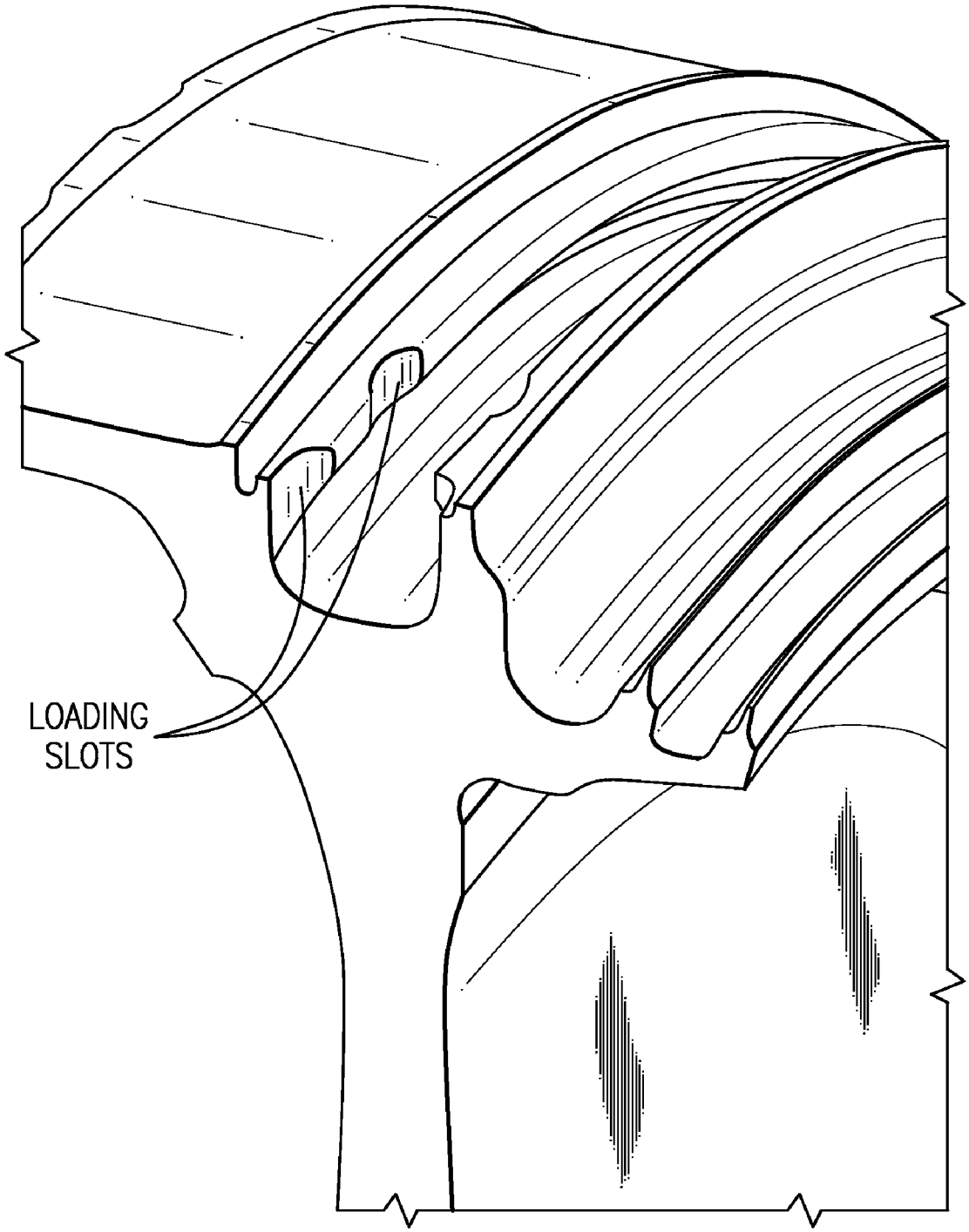
FIG.7 Related Art
FIG. 7 is a perspective view of a Related Art disk assembly which illustrates a blade loading slot.

Since the forward disk section 58A and the aft disk section 58B can be split axially for assembly, no loading slot (FIG. 7; Related Art) is required within the rim 62A, 62B to assemble the rotor blades therein. That is, forward and aft sections of the respective rims 62A, 62B are essentially circumferentially constant so as to essentially trap the blade attachment section 72 therebetween without the heretofore required loading slot (FIG. 7; Related Art). The blades are captured at assembly which eliminates the loading slots and at least some locking hardware.

Elimination of the loading slot reduces concentrated stress levels which may result from slot formation in the otherwise full hoop of disk material. The forward disk section 36A and the aft disk section 36B may also be machined as a set so as to facilitate tolerance error reduction. Additionally, as the disk sections are separable, the rotor blade retention area within the rims 62A, 62B are readily accessible which facilitates repair of the rotor blade contact area within the rotor disk rims 62A, 62B. This accessibility reduces operational costs through extension of the disk service life.

It should be understood that relative positional terms such as "forward," "aft," "upper," "lower," "above," "below," and the like are with reference to the normal operational attitude of the vehicle and should not be considered otherwise limiting.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A split disk assembly for a gas turbine engine comprising:

a forward disk section; and an aft disk section engageable with said forward disk section to retain a multitude of rotor blades therebetween.

2. The assembly as recited in claim 1, wherein said forward disk section is defined by a forward rotor hub.

3. The assembly as recited in claim 1, wherein said aft disk section is defined by an aft rotor hub.

4. The assembly as recited in claim 1, wherein said forward disk section defines a forward rim and said aft disk section defines an aft rim, said forward rim and said aft rim circumferentially constant.

5. The assembly as recited in claim 1, wherein said forward disk section defines a forward rim and said aft disk section defines an aft rim, said forward rim and said aft rim do not include a blade load slot.

6. The assembly as recited in claim 1, wherein said forward disk section and said aft disk section are mountable upon a tie-shaft that generates a compressive load to at least partially retain said forward disk section to said aft disk section.

7. The assembly as recited in claim 1, wherein one of said forward disk section and said aft disk section includes a hub, a rim and a web which extends between said hub and said rim.

8. The assembly as recited in claim 1, wherein said engine stage is a high pressure compressor stage.

9. A split disk assembly for a gas turbine engine comprising:

a forward disk section which at least partially defines an engine stage; and an aft disk section which at least partially defines another engine stage, said aft disk section engageable with said forward disk section to retain a multitude of rotor blades therebetween.

10. The assembly as recited in claim 9, wherein said forward disk section defines a forward rim and said aft disk section defines an aft rim, said forward rim and said aft rim do not include a blade load slot.

11. The assembly as recited in claim 9, wherein said engine stage is an $8^{th}$ stage.

12. The assembly as recited in claim 9, wherein one of said aft rim and said forward rim extends to a hub via a web.

13. The assembly as recited in claim 9, wherein said engine stage is a high pressure compressor stage.

14. The assembly as recited in claim 11, wherein said hub section is defined by a forward rotor hub.

15. The assembly as recited in claim 14, wherein said disk section and said forward hub at least partially defines a $1^{st}$ compressor stage.

16. The assembly as recited in claim 11, wherein said hub section is defined by an aft rotor hub.

17. The assembly as recited in claim 16, wherein said disk section and said aft rotor hub at least partially defines an $8^{th}$ compressor stage.

18. A split disk assembly for a gas turbine engine comprising:

a disk section; and a hub section engageable with said disk section to retain a multitude of rotor blades therebetween.

19. The assembly as recited in claim 18, wherein said disk section includes a hub, a rim and a web which extends between said hub and said rim.

20. The assembly as recited in claim 18, wherein said engine stage is a high pressure compressor stage.

* * * * *